US005095296A

United States Patent [19]

Parker

[11] Patent Number: 5,095,296

[45] Date of Patent: Mar. 10, 1992

[54] SPILT FERRITE BEAD CASE FOR FLAT CABLE

[75] Inventor: Richard G. Parker, Wallkill, N.Y.

[73] Assignee: Fair-Rite Products Corporation, New York, N.Y.

[21] Appl. No.: 636,213

[22] Filed: Dec. 31, 1990

[51] Int. Cl.[5] ..... H01F 27/02; H01F 27/26

[52] U.S. Cl. ..... 336/92; 174/92; 333/12; 336/175; 336/176

[58] Field of Search ..... 174/92, 65 R; 336/174, 336/175, 176, 212, 92; 333/12, 185; 324/127

[56] References Cited

U.S. PATENT DOCUMENTS 4,873,505 10/1989 Matsui ..... 336/92
4,882,561 11/1989 Fujioka ..... 336/175 X
4,885,559 12/1989 Nakano ..... 336/92
4,970,476 11/1990 Kitagawa ..... 336/176 X
4,972,167 11/1990 Fujioka ..... 336/176 X

*Primary Examiner*—Thomas J. Kozma
*Attorney, Agent, or Firm*—Anthony J. Casella; Gerald E. Hespos

[57] ABSTRACT

A split ferrite bead case is provided for a flat conductor cable. The case includes opposed elongated slots for a flat conductor cable to extend through so that the split ferrite bead can suppress electromagnetic interference carried by the flat conductor cable. The opposed elongated slots include cable holding means which are operative to prohibit lateral and angular shifting of the flat conductor cable in the split ferrite bead and prevent the case from sliding along the length of the flat conductor cable.

6 Claims, 2 Drawing Sheets

SPILT FERRITE BEAD CASE FOR FLAT CABLE

BACKGROUND OF THE INVENTION

Electronic devices are known to emit radiation in the form of electromagnetic interference. In an office environment in which several electronic devices coexist, radiation emitted from one device is likely to affect the electronic signal of another device. It is therefore necessary to suppress electromagnetic interference (EMI) by preventing radiation of unwanted radio frequency energy. Conductors in cables connecting electronic devices can serve as radiating elements. To prevent this type of radiation, the EMI carried by these conductors may be attenuated by placing ferrite suppressor beads on the cables at the point of egress from a device that is producing EMI.

Ferrite materials have been found to be extremely effective in suppressing EMI. Ferrite suppressors are magnetic ceramic materials characterized by high magnetic permeability and high electrical resistivity. Ferrite beads, which are illustrated in "FAIR-RITE LINEAR FERRITES", 10th Edition September 1986, distributed by Fair-Rite Products Corporation of Wallkill, N.Y., are produced in a variety of configurations including cylindrical beads, toroid beads and multi-hole beads, all of which are particularly suited for shielding conductive wires from EMI. When a suitable ferrite bead is inserted into a circuit containing d.c. and/or useful signals as well as noise or interference, the desired signals will pass through, while undesirable energy is attenuated. This is accomplished through the impedance of the ferrite bead which is frequency sensitive.

Flat cables are generally composed of a plurality of insulated electrical conductors. The number of conductors can vary from 3 to 4 up to 60 or more. Commonly, the distance between the axial centers of adjacent conductors, or the pitch of the cable, is equal to 0.050 inches. Flat cable configurations promote convenient termination at gang plugs and sockets and are extremely useful in devices having moveable parts in which conductors can become entangled. It is often desirable to suppress EMI in flat cables. Ferrite beads for flat cable come in several configurations. One flat cable suppressor is a one-piece member comprising a rectangular box-like bead having a rectangular path extending therethrough. Another configuration of a flat cable EMI suppressor is the split ferrite bead comprising upper and lower generally rectangular members each having a U-shaped channel disposed therein respectively. The rectangular members are assembled so that the U-shaped channels are opposed and aligned to define a pathway for the flat connector cable. The design of the split ferrite bead is particularly suited for simple retrofits to equipment in both the field and in designing stages. In the past, the two halves of the split ferrite bead were held in intimate contact about a flat cable by a pair of U-shaped clamping clips.

Although split ferrite beads are desirable for flat cables comprising twenty or more conductors, angular shifting within the bead of cables comprising only a few conductors does occur. The movement of the flat cable within the split ferrite bead is undesirable since the impedance encountered by the signal in each of the individual conductors of the flat cable will vary along the width of the cable as it passes through the bead.

Accordingly, it is the primary object of the subject invention to provide a dielectric housing or case for a split ferrite bead having means for prohibiting lateral movement and angular shifting of a flat conductor cable extending therethrough.

It is a further object of the subject invention to provide a split ferrite bead case having means to prevent the case from sliding along the length of a flat cable conductor extending therethrough.

It is still a further object of the subject invention to provide a split ferrite bead case having means for promoting quick and easy access to a flat conductor cable extending therethrough.

SUMMARY OF THE INVENTION

The subject invention is directed to a dielectric case for enclosing the generally rectangular upper and lower halves of a split ferrite bead and which is particularly adapted to permit a flat cable to pass therethrough, whereby the split ferrite bead suppresses the electromagnetic interference by absorbing the unwanted radio frequency energy.

The split ferrite bead case for flat cable of the subject invention is molded of a dielectric material and includes a generally rectangular box-like upper member hingedly attached to a plastic generally rectangular box-like lower member, both having identical linear dimensions. The lower and upper members of the split ferrite bead case include elongated cable pathways. The cable pathways are disposed in both of the opposed side walls of the upper and lower members. Each of the elongated cable pathways includes a pair of spaced apart cable grips. Each of the cable grips comprise a plurality of serrated saw teeth having a pitch approximately equal to 0.050 inches, which is generally equal to the diameter of a single conductor of a flat cable.

Each of the upper and lower members of the split ferrite bead case includes a pair of opposed bead engaging stems. The engaging stems extend inwardly from the opposed side walls of the upper and lower members respectively. The inwardly extending stems are provided to engage a pair of cylindrical cavities disposed in the sides of the upper and lower halves of the split ferrite bead so as to secure the split ferrite bead in the case.

The upper and lower members of the ferrite bead case of the subject invention further include a pair of opposed cantilevered pressure tabs. The opposed pressure tabs in the upper member are disposed in the top surface thereof adjacent the front and rear walls respectively. The opposed pressure tabs in the lower member are disposed in the bottom surface thereof adjacent the front and rear walls respectively. The cantilevered pressure tabs are provided to exert an inward force upon the unexposed surfaces of the upper and lower halves of the split ferrite bead so as to ensure intimate contact between the upper and lower halves of the split ferrite bead.

The ferrite bead case of the subject invention further includes a unitarily formed locking mechanism. The locking mechanism comprises a pair of spaced apart ramped locking tangs and a generally E-shaped deflectable clasp. The ramped locking tangs extend outwardly from the outer surface of the front wall of the lower member. The deflectable clasp extends outwardly from the outer surface of the front wall of the upper member. Upon closing of the split ferrite bead case, the deflectable clasp slides over the locking tangs and thereafter engages the locking tangs so as to lock the case in a closed position.

In operation the generally rectangular lower and upper halves of the split ferrite bead are respectively placed into both the lower and upper members of the case, and are engaged by the inwardly extended bead engaging stems so as to be secured therein. Thereafter, a flat cable is placed upon the lower half of the split ferrite bead in the lower member and aligned within the serrated gripping teeth. At such a time the upper member is closed upon the flat cable. Subsequently, the E-shaped deflecting clasp slides over the ramped locking tangs and engages the tangs such that the case is locked in the closed position. The cantilevered pressure tabs in the lower and upper members function to urge the two halves of the split ferrite bead together so as to facilitate maximum closure around the flat cable.

Upon locking the split ferrite bead case of the subject invention, the plurality of spaced apart cable grips comprising a plurality of serrated gripping teeth, are in intimate contact with a plurality of the electrical conductors of the flat cable. Accordingly, the serrated gripping teeth primarily function to grip the flat cable, thus preventing the case from slipping along the length of the cable. The serrated gripping teeth further function to prohibit angular and lateral shifting of the flat cable within the split ferrite bead, thereby ensuring proper suppression of unwanted radio frequency energy.

DETAILED DESCRIPTION OF THE PREFERRED EMBODIMENT

Figure 1:
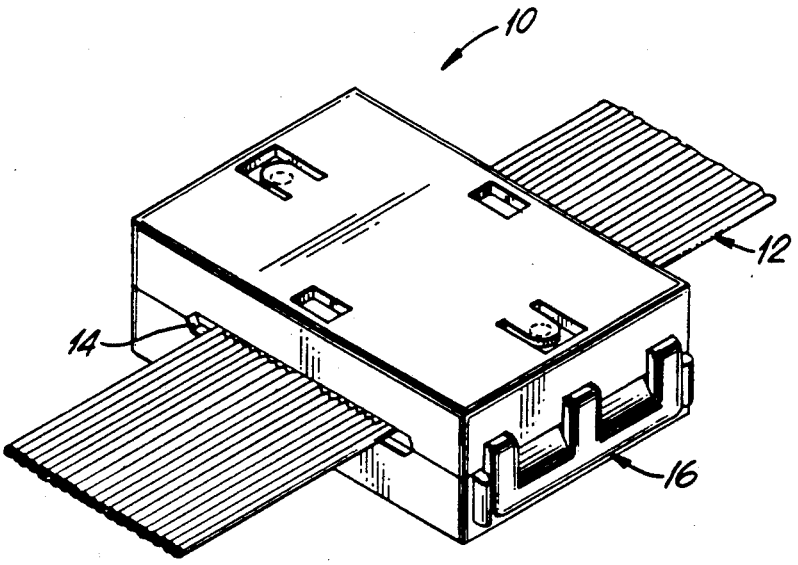
FIG. 1 is a prospective view of the ferrite bead case of the subject invention, as disposed about a section of flat conductor cable.

Referring to FIG. 1, the ferrite bead case of the subject invention is designated generally by reference numeral 10. The bead case 10 is molded from a dielectric material and is provided to house a generally rectangular split ferrite bead (not shown). The split ferrite bead is intended to suppress electromagnetic interference (EMI) in a flat conductor cable. A flat conductor cable 12 extends through the split ferrite bead by entering the bead case 10 through an elongated pathway 14 in one of the opposed sides of the case, and exiting the bead case 10 through a similar pathway in the other opposed side of the case. The bead case 10 includes a locking mechanism 16 for accessing the flat conductor cable 12 therein, should a retrofit of the flat cable 12 be required.

Figure 2:
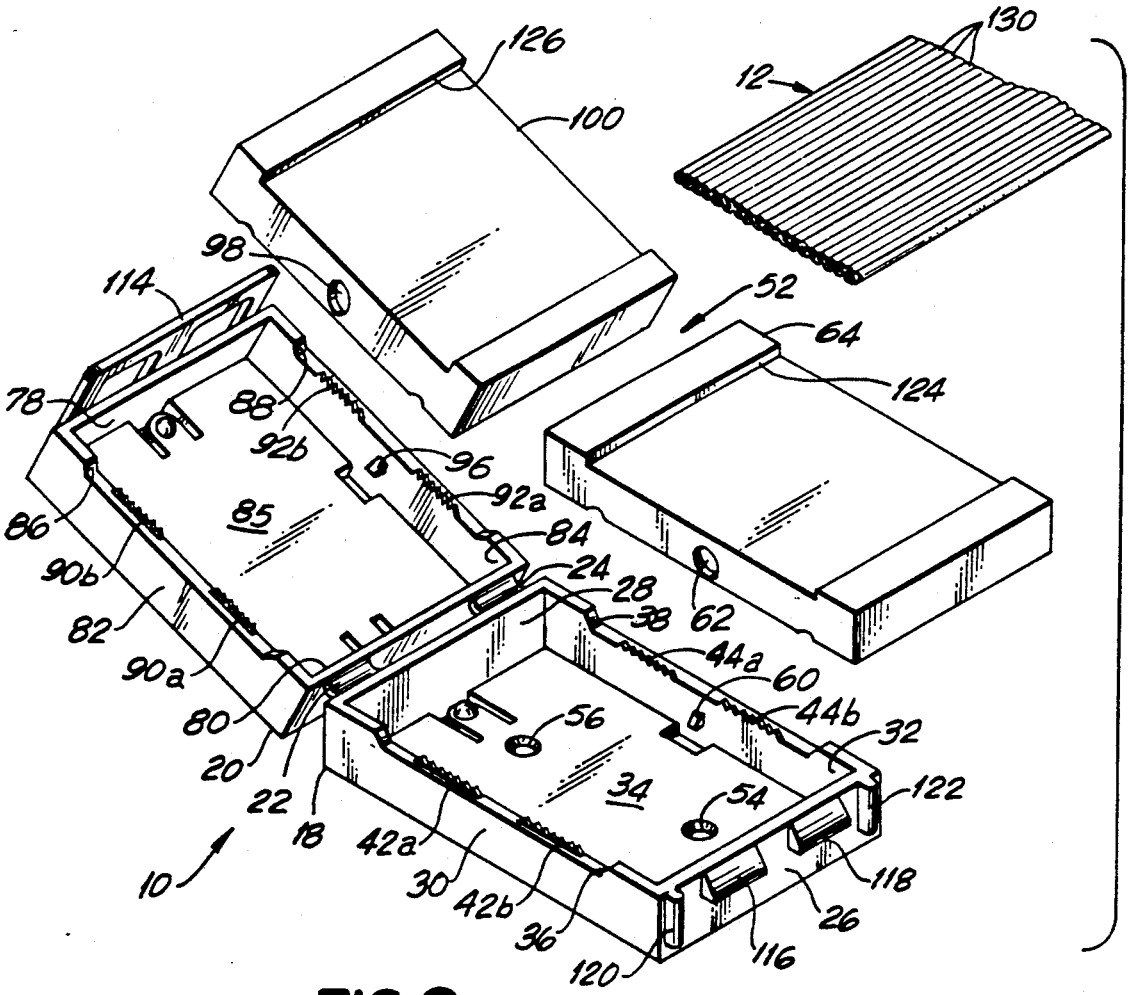
FIG. 2 is an exploded prospective view of the ferrite bead case of the subject invention, along with the split ferrite bead and flat conductor cable.
Figure 3:
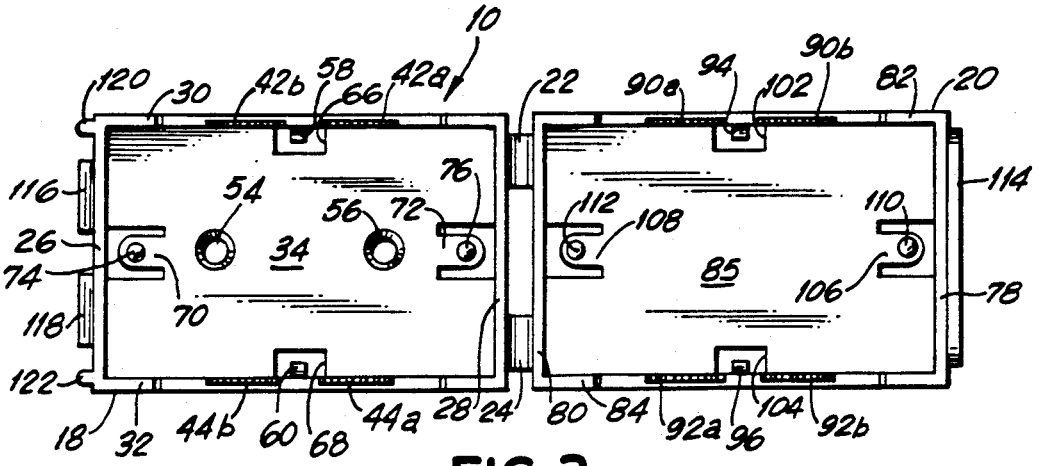
FIG. 3 is a top plan view of the ferrite bead case of the subject invention.

The details of construction of the split ferrite bead case 10 of the subject invention are illustrated in FIGS. 2 and 3. The bead case 10 basically comprises a generally rectangular lower member 18 that is hingedly connected to a generally rectangular upper member 20 by a pair of living hinges 22 and 24. The upper member 20 and the lower member 18 of the bead case 10 have identical planar dimensions.

The lower member 18 of the case 10 comprises a front wall 26, a rear wall 28, opposed side walls 30 and 32, and a bottom surface 34. The opposed side walls 30 and 32 respectively include the lower halves 36 and 38 of the opposed elongated cable pathways 14 and 40. The lower half 36 of the cable pathway 14 in the side wall 30 includes a pair of spaced apart serrated cable grips **42*a* and 42*b*. The lower half 38 of the cable pathway 14 in the side wall 32 includes a pair of spaced apart serrated cable grips 44*a* and 44*b*. The plurality of cable grips 42*a*, 42*b*, 44*a* and 44*b* each comprise a plurality of saw-teeth 50. The plurality of cable grips 42*a*, 42*b*, 44*a* and 44*b* are provided to prohibit movement of the flat cable 12 within a split ferrite bead 52, and to prevent the case 10 from sliding along the length of the flat cable 12**.

The lower member 18 of the bead case 10 further includes spaced apart circular mounting apertures 54 and 56 extending through the bottom surface 34 thereof. The circular apertures 54 and 56 are provided to receive fasteners for mounting of the case 10. Bead engaging stems 58 and 60 extend inwardly from the opposed side walls 30 and 32 respectively, and are disposed intermediate thereupon. The stems 58 and 60 are provided to engage the cylindrical cavities 62 disposed in the sides of the lower half 64 of the split ferrite bead 52 so as to secure the lower half 64 of the split ferrite bead 52 within the lower member 18 of the case 10.

Opposed rectangular slots 66 and 68 extend through the bottom surface 34 of the lower member 18 of the bead case 10. The slots 66 and 68 are disposed adjacent to and intermediate the opposed side walls 30 and 32 of the lower member 18 respectively. The slots 66 and 68 are provided to allow access to the lower half 64 of the ferrite bead 52 should adjustments be required.

Opposed cantilevered pressure tabs 70 and 72 are included in the bottom surface 34 of the lower member 18 of the bead case 10. The pressure tabs 70 and 72 are disposed adjacent to and intermediate the front wall 26 and rear wall 28 of the lower member 18 respectively. The opposed cantilevered pressure tabs 70 and 72 include an upwardly extending hemispherical contact detent 74 and 76 respectively. The pressure tabs 70 and 72 are provided to exert an inward force upon the lower half 64 of the split ferrite bead 52.

The lower member 18 of the bead case 10 is attached to the upper member 20 of the bead case 10 by a pair of spaced apart living flexible hinges 22 and 24. The flexible hinges 22 and 24 are unitarily formed from rear wall 28 of the lower member 18 and the rear wall 80 of the upper member 20.

The upper member 20 of the bead case 10 of the subject invention comprises front wall 78, rear wall 80, opposed side walls 82 and 84, and top surface 85. The opposed side walls 82 and 84 respectively include the upper halves 86 and 88 of the elongated opposed cable pathways 14 and 40. The upper halves 86 and 88 of the opposed cable pathway 14 and 40 correspond to the lower halves of the 36 and 38 of the cable pathways 14 and 40 respectively disposed in the opposed side walls 30 and 32 of the lower member 18. The cable pathway upper half 86 of the cable pathway 14 in the opposed side wall 82 includes a pair of spaced apart serrated cable grips **90*a* and 90*b*. The upper half 88 of the cable pathway 40 in the opposed side wall 84 includes a pair of spaced apart serrated cable grips 92*a* and 92*b*. The plurality of cable grips 90*a*, 90*b*, 92*a* and 92*b* are provided to prohibit movement of the flat cable 12** within the split ferrite bead 52, and to prevent the case 10 from sliding along the length of the flat cable 12.

The upper member 20 of the bead case 10 of the subject invention further includes opposed bead engaging stems 94 and 96. The stems 94 and 96 extend inwardly from the opposed side walls 82 and 84 of the bead case 10 and are disposed intermediate the opposed side walls 82 and 84 respectively. The stems 94 and 96 are provided to engage the cylindrical cavities 98 disposed in the sides of the upper half 100 of the split ferrite bead 52 so as to secure the upper half 100 of the split ferrite bead 52 within the upper member 20 of the case 10.

Opposed rectangular slots 102 and 104 extend through upper surface 85 of the upper member 20 of the bead case 10 of the subject invention. The opposed slots 102 and 104 are disposed adjacent to and intermediate the opposed side walls 82 and 84 of the upper member 20 respectively. The slots 102 and 104 are provided to allow access to the upper half 22 of the split ferrite bead 52 should adjustment be required.

Opposed cantilevered pressure tabs 106 and 108 are included in the top surface 85 of the upper member 20 of the bead case 10. The pressure tabs 106 and 108 are disposed adjacent to and intermediate the front wall 78 and the rear wall 80 of the upper member 20 respectively. Each of the cantilevered pressure tabs 106 and 108 include an upwardly extending hemispherical contact detent 110 and 112, respectively. The opposed pressure tabs 106 and 108 are provided to exert an inward force upon the upper half 100 of the split ferrite bead 52.

The bead case 10 of the subject invention further includes a unitarily formed locking mechanism 16. The locking mechanism 16 is provided to allow quick and easy access to the flat conductor cable 12 should a retrofit be required. The locking mechanism comprises a generally E-shaped deflectable locking clasp 114 and a pair of spaced apart ramped locking tangs 116 and 118. The clasp 114 is disposed on the front wall 78 and of the upper member 20 and extends downwardly therefrom. The spaced apart locking tangs 116 and 118 are disposed on the front wall 26 of the lower member 18 and extend outwardly therefrom. The deflectable clasp 114 is intended to be slid over the ramped locking tangs 116 and 118 and engage the locking tangs 116 and 118 so as to lock the case 10 in a closed position. While sliding over the ramped locking tangs 116 and 118, the clasp 114 is guided by a pair of spaced apart flanges 120 and 122. The flanges 120 and 122 extend outwardly from the front wall 26 of the lower member 18 and are disposed adjacent to the spaced apart tangs 116 and 118 respectively.

To assemble the case 10 of the subject invention, the upper half 100 of the split ferrite bead 52 is placed into the upper member 20. At such a time the opposed bead engaging stems 94 and 96 extend into the cylindrical cavities 98 in the sides of the upper half 100 of the split ferrite bead 52, thereby securing the upper half 100 of the split ferrite bead 52 in the upper member 20 of the case 10. Subsequently, the lower half 64 of the split ferrite bead 52 is placed into the lower member 18 of the case 10. Thereupon, the opposed engaging stems 58 and 60 extend into the cylindrical cavities 62 in the sides of the lower half 64 of the split ferrite bead 52, thereby securing the lower half 64 of the split ferrite bead 52 in the lower member 18 of the case 10.

At such a time, a length of flat cable 12 is positioned in the channel 124 of the lower half 64 of the split ferrite bead 52 and, is aligned in the lower halves 36 and 38 of the opposed cable pathways 14 and 40 disposed in the lower member 18 of the case 10. Thereafter, the upper member 20 is closed upon the lower member 18 such that the upper halves 86 and 88 of the opposed the cable pathways 14 and 40, are in register with the lower halves 36 and 38 of the cable pathways 14 and 40. Accordingly, the flat cable 12 is positioned in the channel 124 of the upper half 100 of the split ferrite bead 52, and is aligned within the upper halves 86 and 88 of the cable pathways 14 and 40.

Subsequently, the E-shaped deflectable locking clasp 114 slides over the spaced apart ramped locking tangs 116 and 118 so as to engage locking tangs 116 and 118 thereby locking the case 10. The cantilevered pressure tabs 70 and 72 in the lower member 18 function to urge the lower half 64 of the split ferrite bead 52 into intimate contact with the upper half 100 of the split ferrite bead 52, thereby insuring maximum enclosure about flat cable 12. Similarly, the cantilevered pressure tabs 106 and 108 in the upper member 20 function to urge the upper half 100 of the split ferrite bead 52 into intimate contact with the lower half 54 of the split ferrite bead 100 further insuring maximum enclosure about flat cable 12.

Figure 4:
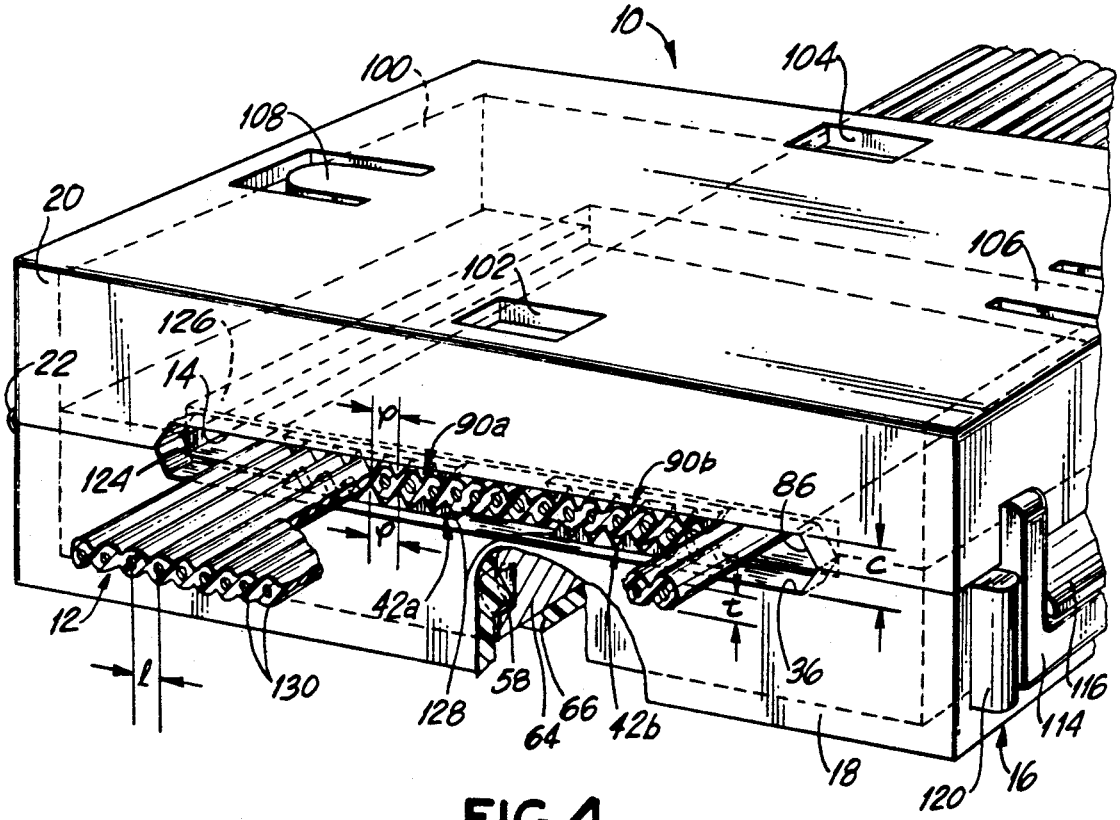
FIG. 4 is an enlarged prospective view of the ferrite bead case of the subject invention illustrating the serrated cable gripping teeth engaging a flat conductor cable.

Turning to FIG. 4, the flat conductor cable 12 is illustrated extending through the elongated cable pathway 16 of the bead case 10. The cable pathway 14, which has a clearance "c" that is wider than the thickness "t" of the flat conductor cable 12, includes an upper half 86 and a lower half 36. The upper half 86 of the cable pathway 14 includes the serrated cable grips 90*a* and 90*b*. Similarly, the lower half 36 of the cable pathway 14 includes the serrated cable grips 42*a* and 42*b*. The cable grips 42*a*, 42*b*, 90*a* and 90*b* each comprise a plurality of saw-teeth 128. The distance between the apices of consecutive serrated saw-teeth 128 of the cable grips 42*a*, 42*b*, 90*a* and 90*b* is equal to a pitch "p". The pitch "p" of the serrated saw-teeth 128 is equal to the pitch "l" of the flat cable 12, or moreover the center-to-center distance of adjacent electrical conductors 130 of the flat cable 12. Accordingly, upon enclosing the bead 10 about the flat cable 12 a majority of the individual conductors 130 of the flat cable 12 are in intimate contact with four adjacent saw-teeth 128. Therefore, upon locking the case 10, the cable grips 42*a*, 42*b*, 90*a*, and 90*b*, together function to prohibit lateral and angular movement of the flat cable 12 within the split ferrite bead 52, and prevent the case 10 from sliding along the length of the flat cable 12.

In summary, a split ferrite bead case for flat cable is provided comprising a generally rectangular box-like upper member hingedly attached to a generally rectangular box-like lower member that includes a plurality of cable grips each comprising a plurality of serrated saw teeth. The case further includes a unitarily formed locking arrangement comprising a deflectable locking clasp on the upper member and a pair of spaced apart ramped locking tangs on the lower member. Cantilevered pressure tabs are included in the lower and upper members that function to urge a pair of generally rectangular ferrite beads into intimate contact around a flat cable, thereby shielding the flat cable from electromagnetic interference.

While the invention has been described with respect to a preferred embodiment, it is apparent that modifications can be made without departing from the scope of the invention as defined by the appended claims.

I claim:

1. A case for housing upper and lower halves of a rectangular split ferrite bead and a flat conductor cable having a selected pitch passing therethrough and being securely retained therein so as to suppress by absorption electromagnetic interference carried by the flat conductor cable, said case and said cable comprising:

a generally rectangular box-like upper member having opposed side walls and opposed end walls;

a generally rectangular box-like lower member having opposed side walls and opposed end walls, said upper member and said lower member being hinged at one end wall thereof, the opposed side walls of said upper and lower members having aligned, elongated serrated grooves formed therein to define passageways enabling said flat conductor cable to pass through the side walls of said case, each said serrated groove having a plurality of serrated gripping surfaces defined by a plurality of saw teeth, said saw teeth being of a pitch corresponding to the pitch of said flat conductor cable; and a locking mechanism unitarily formed on the opposite end walls of said upper member and said lower member to maintain closure of said case about said flat conductor cable, whereby upper and lower halves of a split ferrite bead may be engaged respectively in said upper and lower members of said case and said case may be closed upon said flat conductor cable such that the flat conductor cable may be secured in place by interengagement with said saw teeth of said serrated gripping surfaces so as to prevent said case from slipping along the length of the flat conductor cable and simultaneously prohibiting lateral or angular shifting of the flat conductor cable within said case.

2. A case as in claim 1 wherein said serrated gripping surfaces include a plurality of saw teeth having a pitch equal to 0.05 inches.

3. A case as in claim 1 wherein said upper and lower members both include a pair of opposed cantilevered tabs disposed in the top and bottom surface thereof respectively, for urging upper and lower halves of a split ferrite bead into intimate contact.

4. A case as in claim 1 wherein said locking mechanism includes a generally E-shaped clasp disposed on the outer surface of the front wall of said upper member and a pair of ramped locking tangs disposed on the outer surface of the front wall of the lower member.

5. A case as in claim 1 wherein said upper and lower members are attached at there respective rear walls by a unitarily formed living hinge.

6. A case as in claim 1 wherein said lower member includes a pair of spaced apart circular mounting apertures extended through the bottom surface thereof.

* * * * *